US007017506B2

(12) United States Patent
van Wijngaarden et al.

(10) Patent No.: US 7,017,506 B2
(45) Date of Patent: Mar. 28, 2006

(54) MARGINAL GAS TRANSPORT IN OFFSHORE PRODUCTION

(75) Inventors: Willem van Wijngaarden, Coringhcem (NL); Hein Wille, Eze (FR)

(73) Assignee: Single Buoy Moorings, Inc., Houston, TX (US)

( * ) Notice: Subject to any disclaimer, the term of this patent is extended or adjusted under 35 U.S.C. 154(b) by 295 days.

(21) Appl. No.: 10/349,375

(22) Filed: Jan. 22, 2003

(65) Prior Publication Data

US 2004/0140100 A1 Jul. 22, 2004

(51) Int. Cl.
*E21B 43/34* (2006.01)

(52) U.S. Cl. ..... 114/74 T; 114/256; 62/618; 62/46.2; 166/357; 166/267

(58) Field of Classification Search ..... 114/256, 114/257, 74 T, 74 R; 62/46.2, 618; 166/357, 166/267; 405/210

See application file for complete search history.

(56) References Cited

U.S. PATENT DOCUMENTS

| | | | | |
|---|---|---|---|---|
| 5,199,266 A | | 4/1993 | Johansen | |
| 5,477,924 A | | 12/1995 | Pollack | |
| 6,019,174 A | * | 2/2000 | Korsgaard | 166/352 |
| 6,082,118 A | | 7/2000 | Endrizzi et al. | |

FOREIGN PATENT DOCUMENTS

| | | | |
|---|---|---|---|
| GB | 2229519 A | | 9/1990 |
| JP | 55-99325 | * | 7/1980 |
| JP | 2001-279279 | * | 10/2001 |

OTHER PUBLICATIONS

"NGH on FPSO—Slurry Process and Cost Estimate" by J.S. Gudmundsson, et al., 1999 SPE Annual Technical Conference, Paper SPE56629 (13 pages), Houston, Texas, USA, Oct. 3–6, 1999.

"Stranded Gas To Hydrate For Storage And Transport" by J.S. Gudmundsson and M. Mork, 2001 International Gas Research Conference, paper (13 pages), Amsterdam, Netherlands, Nov. 5–8, 2001.

"Next Generation FPSO: Combining Production and Gas Utilization" by C. Skip Alvarado, et al., all of Fluor Offshore Services Division (Fluor Corporation), Offshore Technology Conference, Paper OTC 14002 (8 pages), Houston, Texas, USA, May 6–9, 2002.

* cited by examiner

*Primary Examiner*—Sunil Singh
(74) *Attorney, Agent, or Firm*—Leon D. Rosen

(57) ABSTRACT

An offshore hydrocarbon production system in which gases are economically stored for transport. After the produced hydrocarbons are separated into liquid (crude oil) and gases, the gases are separated into heavy and light gases. The heavy gases, which consist primarily of propane and butane, are stored as LPG (liquid petroleum gas) in a refrigerated LPG tank. The light gases (methane and other light gases) are hydrated and the ice crystals are stored in a refrigerated hydrate tank.

7 Claims, 2 Drawing Sheets

MARGINAL GAS TRANSPORT IN OFFSHORE PRODUCTION

BACKGROUND OF THE INVENTION

Offshore wells commonly produce hydrocarbons of a wide range of compositions. Those molecules with at least five carbon atoms remain liquid at ambient temperatures and are transported by tankers to offloading facilities. Those molecules with four or less carbon atoms generally form gases at ambient temperatures.

In many cases the undersea well is too far from shore or an existing pipeline to make it economical to transport the gas through an auxiliary pipeline or to a consuming facility (e.g. power plant). Such gas is commonly referred to as marginal gas and has previously been flared (burned). More recent environmental concerns result in prohibitions against flaring of gas. It is possible to inject the gas back into the gas well, but this results in a progressively increasing percent of gas produced from the well, generally making reinjection uneconomical. It is possible to store all the gases in liquid form and at atmospheric pressure but this requires a very low temperature (about −160° C., or −260° F.) which is costly to reach and maintain. Storage at high pressure and moderate temperature to keep the gases liquid, is dangerous and costly. If the gases are transported in a gaseous state, then a very small mass of gas is transported.

There has been a suggestion to convert the gases to hydrates, wherein gas molecules are trapped in water crystals. The hydrates can be transported at moderately low temperatures (e.g. −10° C. to −40° C.) at atmospheric pressure, and they can form a slurry when mixed with crude oil or with water. One problem in converting gases into hydrates is that the economics are not favorable because there is no existing infrastructure for transporting and processing large volumes of hydrates. There are many facilities around the world for receiving LPG (liquid petroleum gas) which includes the heavier gases propane and butane, but few facilities for receiving lighter gases. Also, there are no large facilities for converting gas (and water) into hydrates, and there is presently experience with only small facilities. A system for storage and transport of marginal gas, in a safe and low cost manner based on existing gas handling infrastructure, would be of value.

SUMMARY OF THE INVENTION

In accordance with one embodiment of the present invention, a system and method are provided for the handling of marginal gas at an offshore reservoir, which enables storage and transport of the gas with minimal danger and at minimal cost. The produced hydrocarbons are separated into liquid crude oil and gas. The gas is then separated into heavy gas components comprising primarily propane and butane to constitute LPG (liquid petroleum gas), and light gases that are lighter than propane and butane. The separation is done continuously over a long period of time (usually a plurality of weeks) until tanks are largely filled.

The lighter gases are preferably hydrated, so they can be stored in a tank at higher temperatures and lower pressures (about atmospheric) than are required for light gases that are maintained in a liquid state or dense phase solely by very high pressures and very low temperatures. The heavier gases can be stored in a liquid state at moderately low temperatures. The heavy gases such as LPG and the lighter gases in the form of hydrates are preferably both transported at a pressure close to atmospheric, and at a low temperature. The low temperature is achieved by a refrigeration system in which hot refrigeration gas is cooled by cold water available in the ocean.

The novel features of the invention are set forth with particularity in the appended claims. The invention will be best understood from the following description when read in conjunction with the accompanying drawings.

DESCRIPTION OF THE PREFERRED EMBODIMENTS

Figure 2:
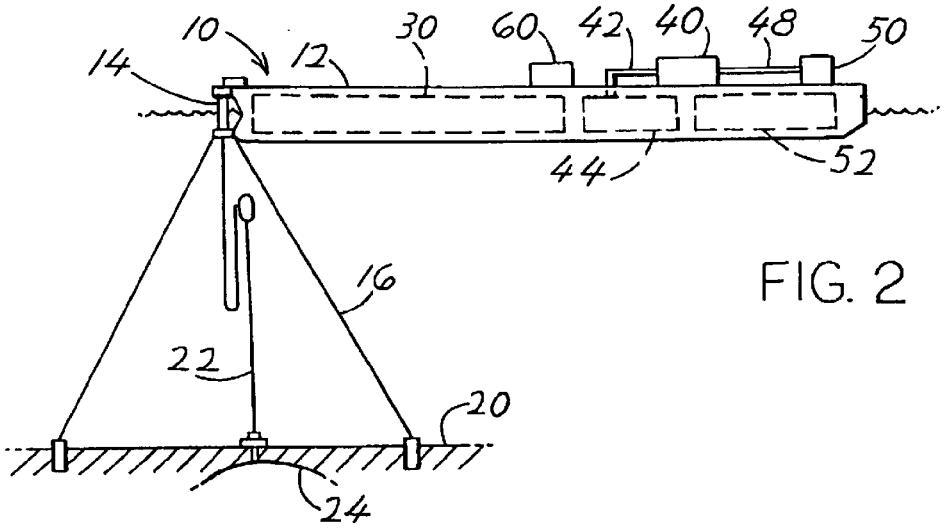
FIG. 2 is a side elevation view of a production and separation system of the present invention.

FIG. 2 illustrates an offshore hydrocarbon production system 10, which includes a floating body in the form of a production vessel 12 anchored through a turret 14 and mooring lines 16 to the seafloor 20. Other types of suitable floating bodies include tension leg platforms and spars. A conduit 22 extends from a seafloor hydrocarbon reservoir 24 and through the turret 14 to the vessel 12. The hydrocarbons produced from the reservoir generally include liquid hydrocarbons (crude oil) and gaseous hydrocarbons. The liquid hydrocarbons are easily separated from the gaseous hydrocarbons, and the liquid hydrocarbons are stored in an oil storage tank 30, as for later offloading onto a tanker perhaps every month. A major problem is how to deal with the gaseous hydrocarbons.

It is assumed that the seafloor reservoir 24 lies far from facilities that can further transport or use the gas such as a gas pipeline or a power plant and it is uneconomical to build a pipeline, so the gas is considered to be marginal gas. Such marginal gas has previously been flared (burned) but environmental considerations now prevent such flaring. One possibility is to pump gas into the oil storage tank 30 or another tank on the same or different vessel, and to carry such gas to a distant facility where it can be used or further transported for use. If the gas is stored at a low pressure such as one or two bars (one bar equals 0.987 atmosphere, or essentially atmospheric pressure which is 14.6 psi), then very little gas can be transported in a very large tank. For example, at two bars, equal quantities of methane, ethane, propane and butane constitute a gas that has a density of about 3.4 kilograms per cubic meter. The gas can be highly compressed as to fifty bars, and be liquid at 0° C. However, it requires a strong tank to hold gas at fifty bars, and the required thickness of the tank walls increases greatly as the diameter of the tank increases, so a tank the size of a typical oil tanker would have to have enormously thick and costly walls. Also, such high pressures result in a very dangerous situation, which is highly undesirable. It is possible to cool the gas to a temperature below −100° C. and maintain it in a liquid condition at a pressure such as about seven one bars. However, temperatures of much less than about −50° C. (−57° F.) are difficult to obtain and maintain in large vessels.

Applicant takes advantage of the different properties of different components of natural gas that accompany crude oil, to facilitate transport of the gas. Gaseous natural hydrocarbons includes four major components referred to by the number of carbon atoms in a molecule. These are methane ($CH_4$ often referred to as C1), ethane ($C_2H_6$, referred to as C2), propane ($C_3H_8$, referred to as C3) and butane ($C_4H_{10}$, referred to as C4). Larger hydrocarbon molecules found in liquid crude oil are referred to as C5 through C40. The heavier gas molecules such as propane and butane, remain in a liquid or solid state at higher temperatures and lower pressures than do the lighter gases C1 and C2. Applicant notes that the normal boiling point temperatures for the above major components of gaseous hydrocarbons are as follows: C1-162° C.; C2-89° C.; C3-42° C.; and C4-12° C. Applicant takes advantage of this by separating the heavier components (C3 and C4) from the lighter ones (C1 and C2) and handling them separately. A mole of a given volume of the heavy gas such as butane will have almost four time the mass of a mole of the same volume of the light gas methane.

On the vessel 12 of FIG. 2, a separator 40 is provided to separate the heavier gases from the lighter ones. The heavier gases are delivered through a conduit 42 to a heavy gas storage tank 44 on the production vessel 12, or on a separate barge or other vessel. The lighter gases are delivered through conduit 48 and are treated by a treatment facility 50 and stored in a light gas tank 52. The light gas tank 52 is shown located on the production vessel 12, but can lie on a separate barge or other vessel.

The heavy gases C3 and C4 delivered to the heavy gas tank 44 are the main constituents in LPG (liquid petroleum gas) which is widely used and therefore the more valuable of the gas components. Other hydrocarbon components may find their way to the heavy gas tank 44, but the components C3 and C4 constitute the majority, by weight, of the gases stored in the tank 44. The heavy gases 44 can be stored and transported as a liquid, at a high pressure of six to fifteen bars and a temperature such 0° C., or at an atmospheric pressure of one bar and a low temperature below −40° C., such as −50° C. As mentioned above, applicant prefers to maintain all gas at substantially atmospheric pressure (less than 2 bars) for safety reasons, so the heavy gas in tank 44 is maintained at −43° C. and a pressure of about one bar.

The light gases (C1 and C2) are stored in the light gas tank 52 in a form that minimizes the required pressure and temperature. Applicant uses the facility 50 to convert the light gases to a natural gas hydrate. In a natural gas hydrate, molecules of hydrocarbon gases are trapped in ice crystals. Such natural gas hydrates can be generated by refrigerating the light gases to −20° C. to −10° C. under a pressure of 60 to 100 bars after the gas has been mixed with water, so a heavy duty facility is required. Basically, the water molecules enclose the light gas molecules, and the water molecules crystalize (freeze) into a solid phase with the light gases trapped therein. Natural gas hydrates contain about 15% weight gas and 85% weight water. Natural gas hydrates maintained at one bar are safe not only because of the low pressure, but because the natural gas is trapped and will be released only slowly as the ice melts, in the event of a catastrophe. Applicant prefers to mix water with the hydrates to form a slurry for rapid offloading from the transport vessel.

As mentioned above, the facility 50 shown in FIG. 2 is used to convert the light gases to hydrates. A facility 50 of moderate size and cost has only a limited capacity to convert gas into hydrates. However, since only the light gases are converted, and the conversion of an amount that fills the tank 52 may occur over an extended period (e.g. a few weeks), a moderate size conversion facility can convert sufficient light gases to prepare all light gas for transport, and fill much of the hydrate tank 52. Since the facility does not form a hydrate of the heavier gases, only a moderate size hydrating facility 50 is required.

Figure 3:
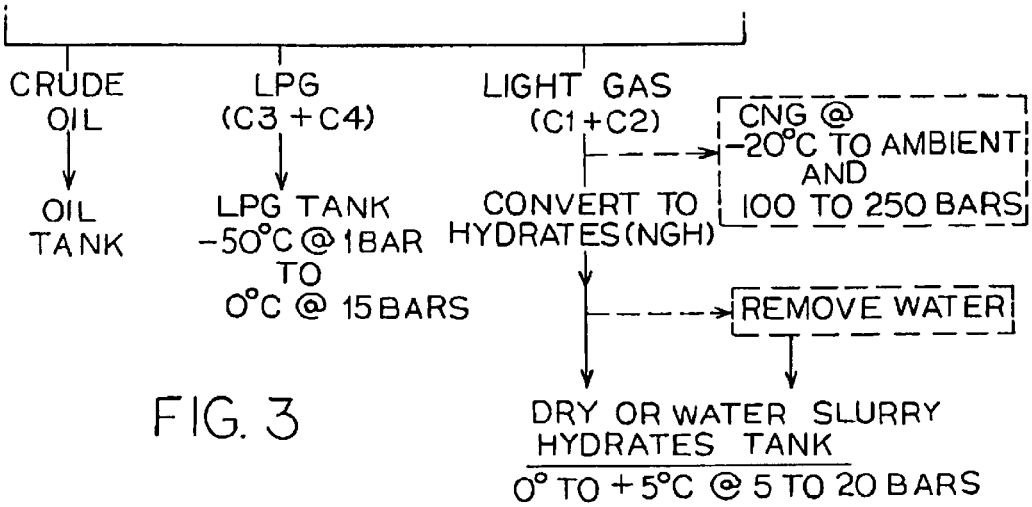
FIG. 3 is a diagram indicating storage possibilities for different components of produced hydrocarbons.

As shown in FIG. 3, LPG can be maintained liquid at one bar and −50° C., while hydrates can be maintained at one bar at minus −40° C. or somewhat higher. These temperatures of about −50° C. and −40° C. are close, so it is convenient to place both tanks 44, 52 in the same vessel (e.g. a barge), and to even use the same refrigeration system 60 to cool both tanks. The stored LPG and hydrates each can be pumped into separate tanks on a shuttle tanker, or into the tanks of a LPG shuttle tanker and a hydrate shuttle tanker. LPG is not hydrated, so it can be removed from the shuttle tanker with little processing, except that it is usually necessary to heat the LPG in order to provide gas to flow to a facility such as an LPG pipeline or distribution facility.

The hydrates in the light gas tank 52 can be removed in a number of ways. As mentioned above, water is preferably added to the ice crystals to form a slurry into a hydrate tank of a shuttle tanker.

Figure 1:
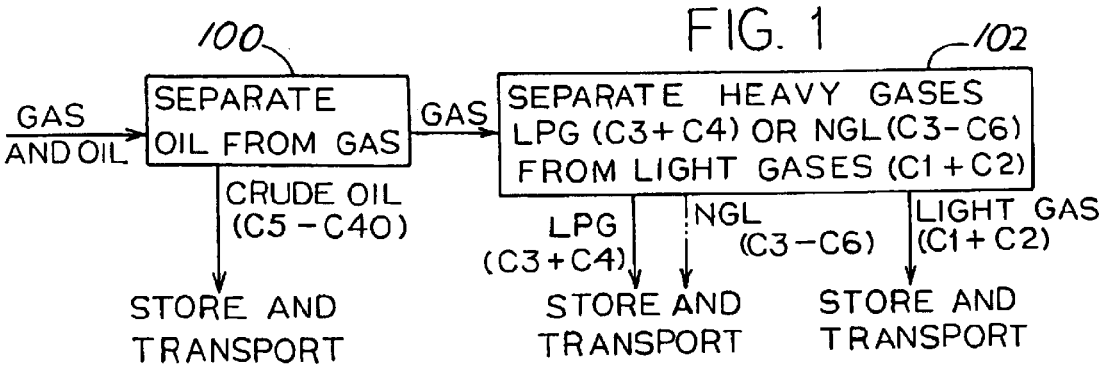
FIG. 1 is a block diagram indicating the basic process of the invention.
Figure 4:
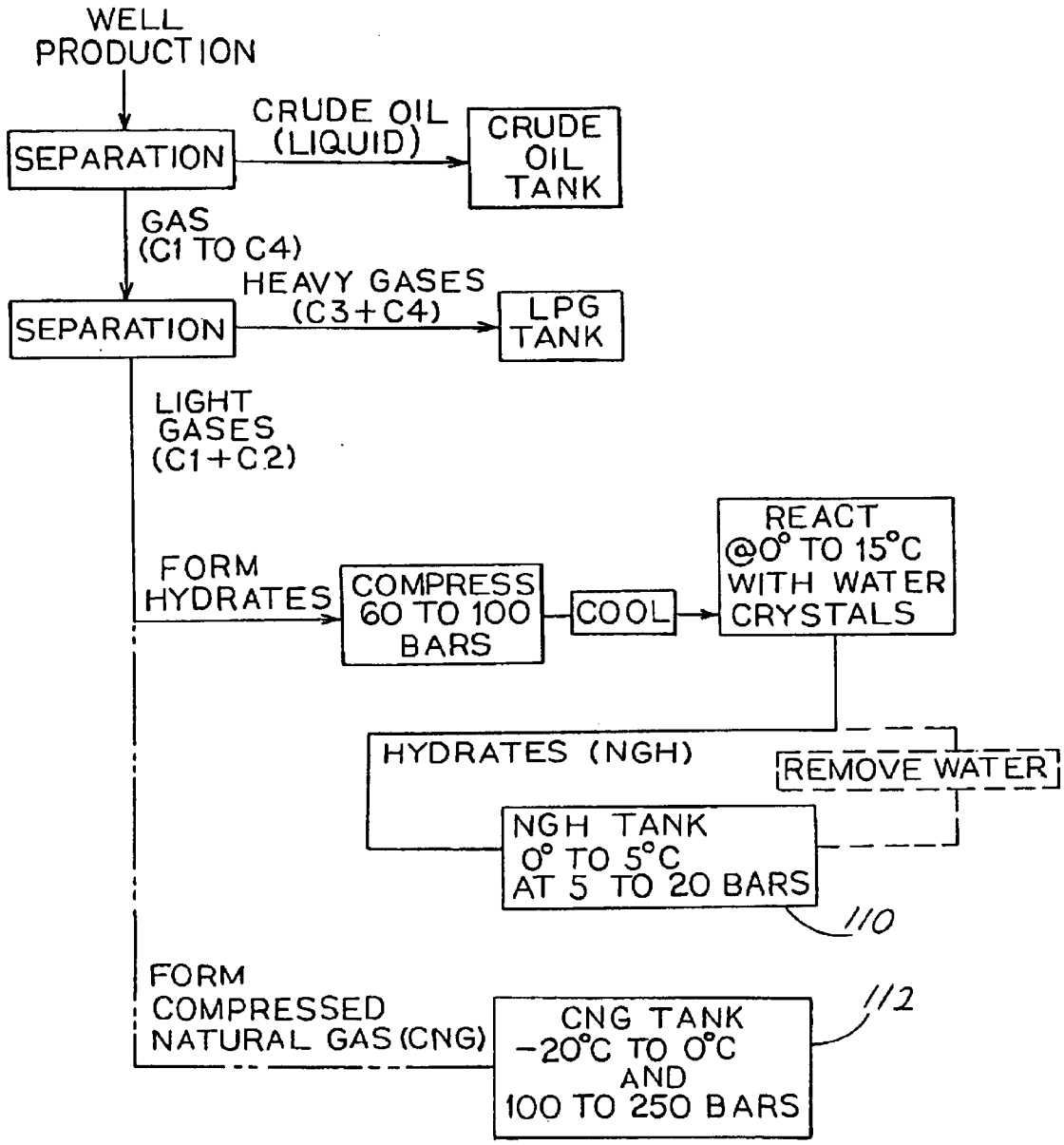
FIG. 4 is a block diagram showing steps taken in the processing of produced hydrocarbons for storage and transport.

FIG. 1 shows that the basic process is to separate oil from gas at 100 and separate heavy gases (largely C3 and C4) from light gases (largely C1 and C2). The heavy gases (LPG) are stored at moderately low temperatures and pressures, while light gases can be converted to hydrates to store at moderate temperatures and pressures. Alternatively, light gases can be stored as CNG (compressed natural gas), which is not preferred but may be feasible because of the reduced volume due to the heavy gases having been removed. FIG. 4 shows the entire process, including the alternatives at 110 and 112 for light gases.

Thus, applicant transports gaseous hydrocarbons components from the vicinity of a reservoir, primarily C1 through C4, by placing them in tanks for transport to a distant facility. Applicant prefers to separate heavy gas components C3 and C4 and store them in a separate tank, because gas consisting primarily of these two components is considered to be LPG (liquid petroleum gas) which has a high value, and because such "heavy gases" liquify at a higher temperature and lower pressure than lighter gases. Applicant prefers to store light gases, primarily C1 and C2, in a separate tank. It is possible to store the light gases as compressed natural gas at one bar and very low temperatures (often well below −100° C.), but it is very difficult to maintain such a low temperature for a long period in a vessel. Applicant can instead maintain light gases at a moderately low temperature and high pressure (e.g. at −40° C. and six bars), but such high pressure of compressed gas is dangerous and very strong tank walls are required to hold a high pressure in a large tank. Applicant prefers to hydrate the light gases to form hydrates that can be stored at one bar and about −40° C. to −10° C. Since LPG can be maintained at one bar and −50° C. and hydrates can be maintained at one bar and −40° C., applicant can more easily maintain the LPG and hydrates tanks on the same vessel and cooled by the same refrigeration system. The hydrates are maintained in substantially a nongaseous state (liquid or solid), because the gas molecules are trapped in ice (which may flow as a slurry if water is added, which is preferred). The fact that only light gases are hydrated reduces the required size of a facility to convert the light gases to hydrates, and enables rapid offloading of heavy gases, such as LPG.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. A method for treating and transporting produced hydrocarbon gases that are produced from a hydrocarbon reservoir, where said produced hydrocarbons gases include the gases propane, butane and methane, comprising:

separating said produced hydrocarbon gases into LPG (liquid petroleum gas) that consists primarily of propane and butane, and into lighter gases that include primarily gases that each has a lesser density than propane at the same pressure and temperature, wherein said lighter gases include methane;

cooling the LPG to below a temperature at which the LPG is liquid at a pressure of one bar, storing and transporting the liquid LPG in a tank that lies in a floating body, and storing and transporting the lighter gasses in a tank that lies in a floating body;

said step of storing and transporting the lighter gasses comprises combining them with water and cooling them to produce a hydrate that comprises the lighter gasses in ice crystals, and transporting and storing the hydrate.

2. The method described in claim 1, wherein:

said step of storing and transporting the light gases includes maintaining the hydrates at a temperature below the freezing point of water and at a pressure of about that of the environment.

3. The method described in claim 1, wherein:

said LPG and said hydrates of light gasses are each stored at a pressure of about one bar, and at a temperature of about -30°C.

4. The method described in claim 3, wherein:

said tank that holds LPG and said tank that hold hydrates of light gases lie in the same floating body and are both cooled by the same refrigeration system.

5. A system for utilizing gas produced at an offshore production installation that produces hydrocarbons from an undersea reservoir, where the hydrocarbons comprise heavy gases that are of a density at least as great as propane, at the same temperature and pressure, and also comprise light gases that are of lower density than propane at the same pressure and temperature, wherein the light gases include at least methane, comprising a separator that separates said heavy gases from said light gases;

a hydrate-forming apparatus which combines only said light gases and water into a hydrate;

apparatus that cools said heavy gases to a temperature below that at which said heavy gases are liquid at a pressure of one bar;

a first tank that stores said liquid heavy gases;

a second tank that stores said hydrates.

6. The system described in claim 5, including:

a transport ship, said first and second tanks both mounted in said ship, with said hydrates comprising a slurry of solid ice crystals, and a refrigeration system on said ship that cools both of said tanks.

7. The system described in claim 5, wherein:

said system is designed to produce crude oil at approximately a predetermined rate;

said hydrate forming apparatus has sufficient capacity to combine with water, the amount of light gases produced when crude oil is produced at said predetermined rate, to produce hydrates, only if said hydrate forming apparatus operates substantially continuously, but not to produce hydrates if both said heavy gases and said light gases had to be hydrated.

* * * * *